United States Patent [19]

Schinner

[11] 3,963,464

[45] June 15, 1976

[54] GAS WASHER AND LIQUID TREATMENT SYSTEM

[75] Inventor: Edward N. Schinner, Silver Spring, Md.

[73] Assignee: Merck & Co., Inc., Rahway, N.J.

[22] Filed: Mar. 6, 1974

[21] Appl. No.: 448,760

[52] U.S. Cl. ..... 55/228; 55/257 NP; 210/310; 261/116

[51] Int. Cl.[2] ..... B01D 47/06

[58] Field of Search ..... 55/227, 228, 257, 85; 261/116; 210/311, 310

[56] References Cited

UNITED STATES PATENTS

| | | | |
|---|---|---|---|
| 1,952,989 | 3/1934 | Joseph | 55/481 |
| 2,575,499 | 11/1951 | Manow | 55/481 |
| 2,802,543 | 8/1957 | Clark | 55/227 |
| 3,807,145 | 4/1974 | Engalitcheff et al. | 55/228 |
| 3,834,539 | 9/1974 | Thompson | 210/310 |

*Primary Examiner*—Bernard Nozick

*Attorney, Agent, or Firm*—Michael C. Sudol, Jr.; J. Jerome Behan

[57] ABSTRACT

An injector type spray cooling system is described having a cooled water recovery sump in which water is directed through a strainer slanted with its upper edge upstream so that a self cleaning action is produced.

11 Claims, 4 Drawing Figures

GAS WASHER AND LIQUID TREATMENT SYSTEM

BACKGROUND OF THE INVENTION

1. Field of the Invention

This invention relates to the treatment of liquids and more particularly it concerns novel structures for straining liquids in liquid treatment systems.

The present invention is particularly useful as embodied in injector type air-liquid contact apparatus such as the evaporative cooling systems shown and described in U.S. patent application Ser. No. 144,853 filed May 19, 1971. These systems are also known as ejector type cooling systems. In such systems, water to be cooled is intimately mixed with atmospheric air and a small portion of the water evaporates into the air with the result that the remaining, major portion, of the water is cooled. Because of the intimate mixing of atmospheric air with the liquids to be cooled a substantial amount of foreign particulate matter carried along by the atmospheric air becomes entrained by liquid and tends to contaminate it.

2. Description of the Known Prior Art

In the past, various straining means have been employed for removing the entrained contaminants from the cooled liquid. In the aforesaid copending application, for example, a strainer screen is positioned across a sump so that it lies perpendicular to the flow of liquid in the sump. Another strainer arrangement but with the strainer still perpendicular to liquid flow is shown in U.S. Pat. No. 1,564,075. In addition, in Australian Pat. No. 268,590, there is shown a strainer which slants in the direction of liquid flow with its upper edge in the downstream direction. While these straining means did perform their straining tasks quite adequately, they did require periodic cleaning or replacement at intervals depending upon the liquid flow rate, the degree of liquid contamination, and the size of the strainer openings.

SUMMARY OF THE INVENTION

The present invention provides a straining arrangement which requires less regular cleaning and replacement than has heretofore been necessary. Actually, the straining arrangement of the present invention serves to provide a self flushing or washing action whereby a substantial portion of the solid material separated by the strainer is automatically removed from it. This separated matter is trapped at a location adjacent to the strainer where it does not interfere with liquid flow through it.

According to one embodiment of the present invention there is provided, in an evaporative type cooling system, a sump through which liquid to be strained flows in a given direction. The cross sectional dimensions of the sump, transverse to the flow direction, are quite large so that the linear flow velocity through the sump is relatively low. An expansive strainer is positioned in the sump to extend across its cross section. The strainer is tilted so that its lower edge, which is at the bottom of the sump, is further downstream than its upper edge. As liquid flows through the strainer, particulate matter is separated from the liquid and is caught on the upstream surface of the strainer. Because the surface is tilted to face downwardly, the particulate matter may fall off the strainer down toward the sump flow. Further, the tilt of the strainer permits a component of the forward flow velocity of the liquid to produce a continuous flushing action in a downward direction whereby the separated particulate matter is forced down toward the lower edge of the strainer.

In the preferred embodiment of the invention there is provided a pair of guide channels mounted on opposite side walls of the sump. A generally rectangular frame containing a strainer screen is dimensioned to slide along in these channels to the above described slanted position. The strainer screen may be removed simply by sliding it up along the channels and out from their upper ends.

The present invention in one aspect makes possible a backflush cleaning action upon shut-off. That is, when the system is shut off, the residual head of water above the sump will cause a backflow through the strainer in a manner such that the strainer is cleansed of previously accumulated foreign matter.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

A number of embodiments of the invention have been chosen for purposes of illustration and description, and are shown in the accompanying drawings, forming a part of the specification, wherein.

DESCRIPTION OF THE PREFERRED EMBODIMENTS

Figure 1:
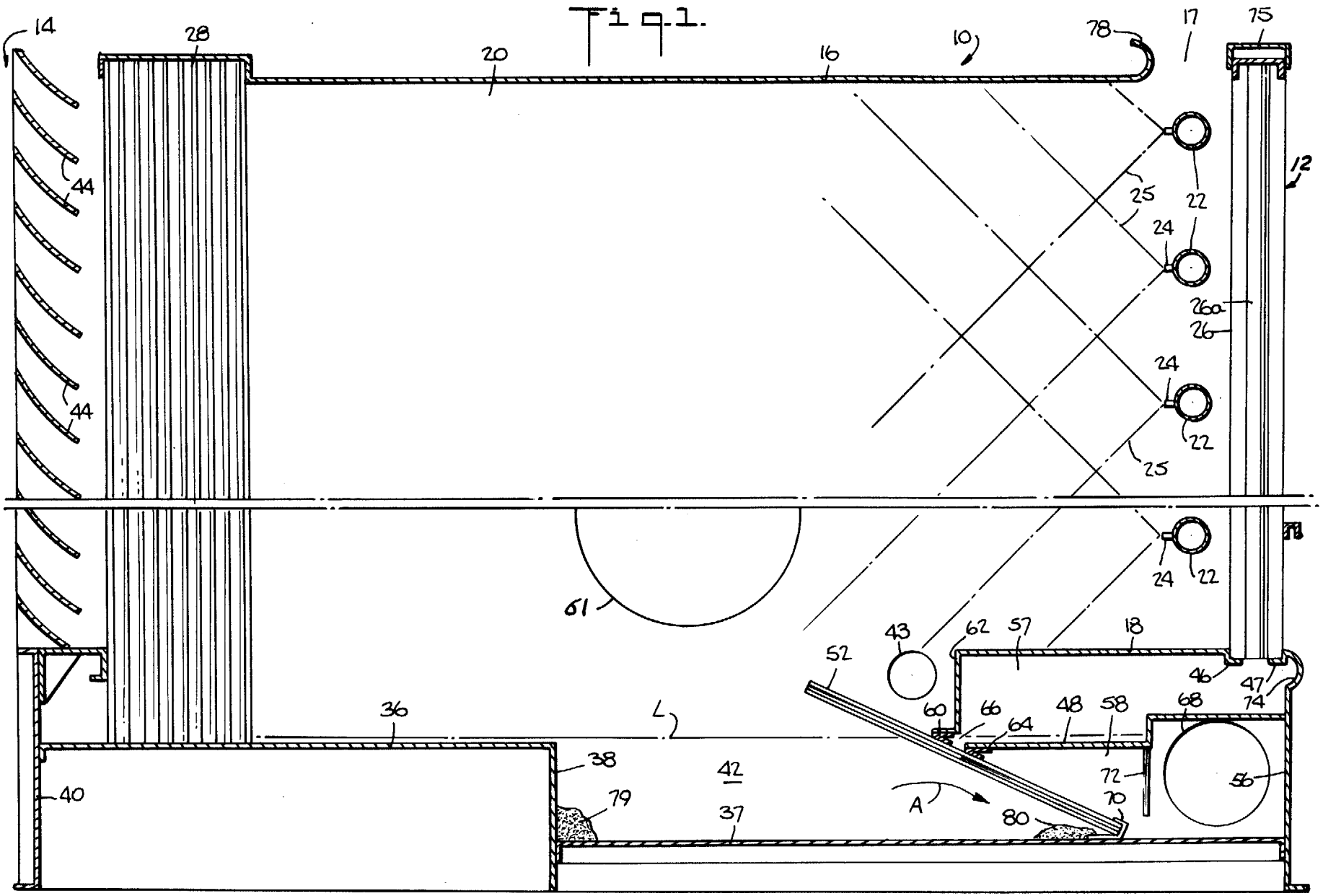
FIG. 1 is a side elevational view taken in section, and partially cut away, illustrating an injector type cooling tower having a novel strainer arrangement constituting a preferred embodiment of the present invention.

The injector type cooling tower of FIG. 1 comprises a conduit 10 formed of sheet material and having a generally rectangular cross section of uniform dimensions throughout its length. The conduit 10 has an air inlet end 12 and an air outlet end 14 both open to the atmosphere. Between these two ends, the conduit 10 is made up of a top wall 16, a bottom spray seal plate 18 and the horizontal extension thereof, and side walls 20.

A plurality of water supply manifolds 22 extend parallel to each other horizontally across the conduit interior near the air inlet end 12. Water to be cooled is pumped by external means (not shown) to these manifolds. A plurality of spray nozzles 24 are provided at spaced apart locations on each of the manifolds 22 and these spray nozzles are aimed to project sprays of water 25 into the conduit 10 toward its air outlet 14.

The water sprays 25 from the nozzles 24 are of generally flat, fan shaped configuration. That is, the sprays diverge much more extensively in the vertical direction than in the horizontal direction. As pointed out in previously mentioned U.S. patent applicaton Ser. No. 144,853, this serves to maximize cooling and air entrainment. The nozzles of each conduit are aligned with corresponding nozzles in the other conduits.

At the air inlet end 12 of the conduit 10, as shown in FIG. 1 there are provided a plurality of closely spaced vertical air flow stabilizing strips 26 distributed across the conduit cross section just upstream of the water supply manifolds 22. These inlet air stabilizing strips are of thin sheet material and they are positioned to lie in planes which are essentially parallel to the planes of the sprays from the nozzles 24. The strips 26 are formed with at least one corrugation 26*a* and these corrugations are aligned with each other so that the strips are spaced apart with minimal overlap of these corrugations 26*a*.

Also as shown in FIG. 1, there are provided a plurality of spaced apart liquid-air separator strips 28 near the air outlet end of the conduit 10. These separator strips also are of sheet material and they are positioned to lie in vertical planes distributed across the conduit cross section.

Toward the outlet end 14, a lower water collection shelf 36 is supported a short distance above a bottom wall 37 by vertical walls 38 and 40. A sump 42 is formed immediately below the conduit 10. The lower extent of the sump is defined by the bottom wall 37 and the lower water collection shelf 36, and the upper extent is defined by the level of the water contained therein.

The wall 40 ends up higher than the shelf 36 and serves to prevent water from flowing forwardly out of the sump 42. As shown by the phantom line L, the water level in the sump 42 is normally maintained slightly above the level of the shelf 36. An overflow duct 43, near the other end of the unit prevents this water level from rising too high.

A plurality of curved turning vanes 44 extend horizontally across the conduit 10 downstream of the liquid-air separator strips 28. These turning vanes are curved upwardly from the horizontal; and they serve to deflect moisture laden air exiting from the conduit 10 up and away from the conduit so that it cannot be recirculated back into the inlet end 12. It will be appreciated that these turning vanes are open to the atmosphere and that no special protective structures such as scoops, baffles or the like, are used.

The air flow stabilizing strips 26 are supported at their lower ends by means of brackets 46 and 47 located just above a strainer cover 48. The forwardmost bracket 46 is integral with the bottom spray seal plate 18. The downstream ends of the strainer cover 48 and the bottom spraying seal plate 18 are connected to slanted guide brackets 52 which hold a strainer 54.

Figure 2:
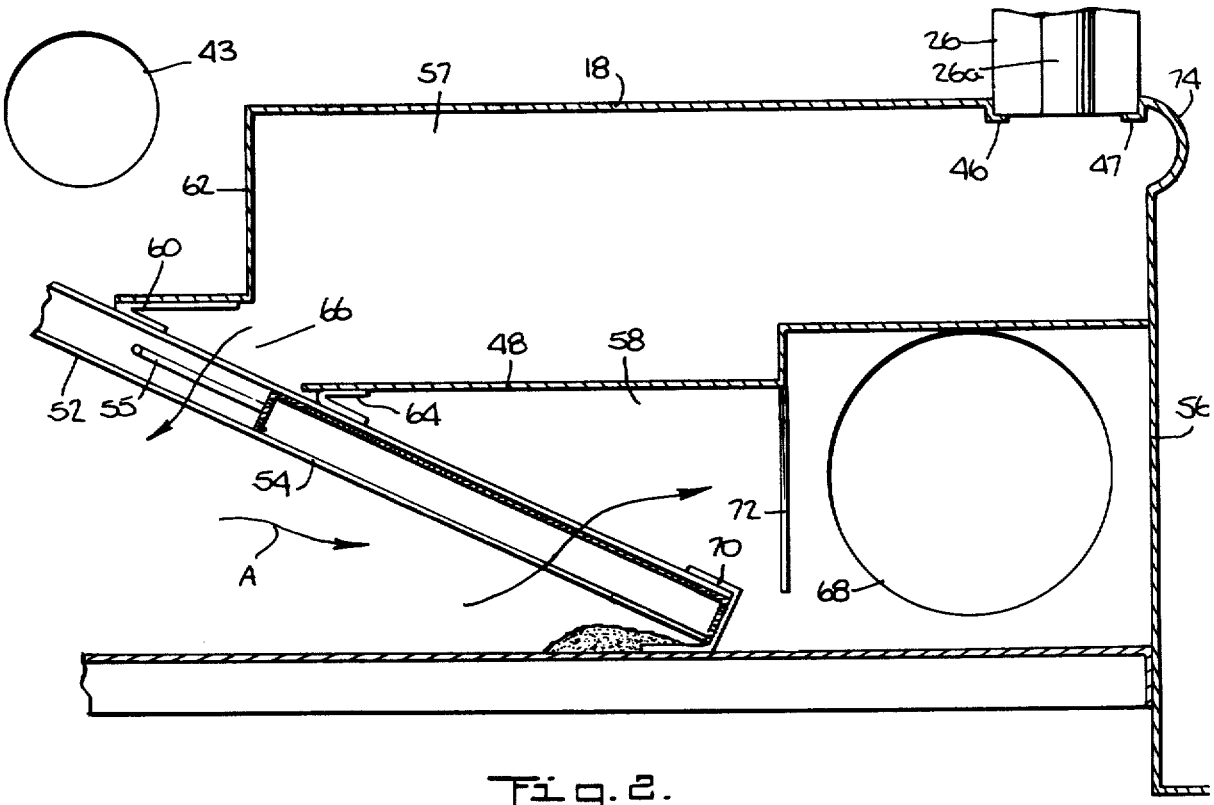
FIG. 2 is an enlarged fragmentary view of the strainer region of the cooling system of FIG. 1.

As can be best seen in FIG. 2, the region of the sump 42 under the spray seal plate 18 is divided into upper and lower compartments 57 and 58 by means of the strainer cover 48. As shown, the strainer cover 48 extends parallel to and under the spray seal plate 18; and it is bent down and back along the downstream edge to form a strengthening flange 60.

The spray seal plate 18 is also bent downwardly along its downstream edge to form a forward abutment wall 62. The lower edge of this wall is bent forwardly and then back to form a further flange 64 positioned slightly above and beyond the partition flange 60. The two flanges 60 and 64 define between them a slot 66 which extends across the conduit 10 and which provides an outlet from the upper compartment 57. The space between the bracket 46 and 47 supporting the air flow stabilizing strips 26 forms an inlet to the upper compartment 57.

An outlet opening 68 in one of the conduit sidewalls provides an outlet from the lower compartment 58. This opening is connected to external piping (not shown) which delivers cooled water from the system to various external utilization means. The area between the flanged edge 60 of the strainer cover 48 and the bottom wall 37 provides an inlet to the lower compartment 58.

Figure 3:
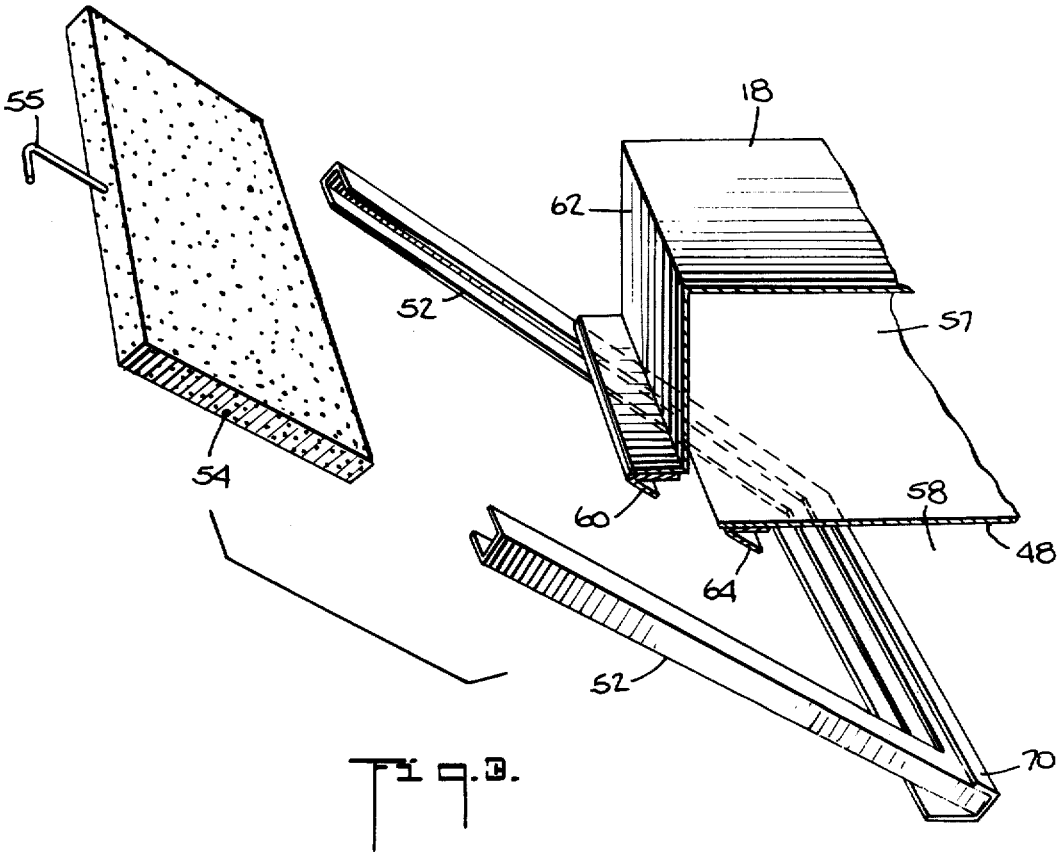
FIG. 3 is an exploded perspective view of a portion of the strainer region of FIG. 2.

As shown in FIGS. 2 and 3, the strainer 54 is of generally flat rectangular configuration and is positioned to extend across the conduit 10 and along the bottom wall 37 to cover the inlet to the lower compartment 58. The strainer 54, as shown in FIG. 3, is of rigid box-like construction and may be formed by bending the edges of a perforated metal sheet into a frame like arrangement. The lateral edges of the strainer 54 fit snugly but loosely in the guide brackets which in turn are secured in slanted position to the sidewalls of the conduit 10. A bottom channel member 70 extends along the bottom wall 37 between the lower ends of the guide brackets 52 to accommodate the bottom edge of the strainer 54 and hold it against the bottom wall 37.

As shown, the guide brackets 52 are slanted so that their lower ends are closer to the lower compartment outlet opening 68 while their upper portions extend rearwardly and upwardly past the flanges 60 and 64. When the strainer 54 is in place between the guide brackets 52 and the bottom channel member 70, it extends across and covers the inlet opening to the lower compartment 58 and is tilted so that its lower edge is closer to the outlet opening 68. When the strianer 54 is in place, as shown in FIG. 2, its upper edge does not extend above the strainer cover 48. Thus, the slot 66 forming the outlet from the upper compartment 57 is not covered by the strainer.

The strainer 54, as shown in FIG. 3, is easily removed for cleaning or replacement, simply by grasping a handle 55 on its upper edge and pulling it up along the guide brackets 52 and out from their open upper ends. The strainer may then be removed from the conduit 10 out through a removable access door 61 (FIG. 1) in one of the conduit side walls 20.

A tapered liquid flow control plate 72 extends across the sump 42 between the strainer 54 and the water outlet port 68. This plate extends from the bottom of the strainer cover 48 to a level close to the bottom wall 37 near the outlet port 68, and it tapers up to a progressively higher level toward the opposite side of this device. This restricts the flow of water to a greater extent in the region of the outlet port 68 and thereby serves to maintain an even flow of water through the strainer 54 in all regions thereof.

A curved lower air inlet lip 74 extends across the conduit air inlet end 12 along the lower ends of the air flow stabilizing strips 26. This curved lip serves to maintain a smooth eddy free flow of air into the lower regions of the conduit.

An upper support channel 75 maintains the upper ends of the air flow stabilizing strips 26 in position. Just downstream of the bracket 75 there is provided an upper air inlet slot 77 which extends across the top of the conduit 10 to a location slightly past the water supply manifolds 22. The top wall 16 of the conduit is curved up and back to form an upper air inlet lip 78 along the downstream edge of the slot 77. This slot and lip arrangement serves to improve and increase inlet air flow and to prevent ice formation.

In operation of the system described above water to be cooled is supplied under pressure from an external source (not shown) to the water inlet manifolds 22; and from there the water is sprayed out through the nozzles 24 into the conduit 10 toward its discharge opening 14. These water sprays cause air to be injected into the inlet opening 12 and to be pumped through the conduit along with the sprayed water. This incoming air passes both between the air flow stabilizing 26 strips and through the air inlet control slot. These inlet air control arrangements serve to maintain a maximum flow of air in a smooth, non-turbulent manner as described in copending U.S. patent application Ser. No. 448,758, filed Mar. 6, 1974 in the names of John Engalitcheff, Wilson Bradley and Edward N. Schinner.

The air passing through the conduit 10 mixes intimately with and cools the sprayed water by dual, mutually cooperative processes of sensible and latent heat transfer as explained in the above mentioned copending application.

The liquid sprays from the nozzles 24 impinge upon the liquid-air separator strips 28, and because of the corrugations on these strips the forward velocity component of the liquid sprays is severely retarded. As a result, the relative magnitude of the gravity component increases and the liquid sprays are caught upon and flow down the sides of the strips toward the lower water collection shelf 36. Meanwhile, the air which had been pumped through the conduit 10 passes horizontally between the liquid air separator strips 28 with almost no effect on its forward velocity. As is also explained in the above identified copending application, this outward movement of air across the downwardly flowing water on the strips of the liquid-air separator means 28 produces an additional heat transfer to enhance the cooling of the water. The air then exits out and away from the conduit 10 through the turning vanes 34.

The cooled water which has flowed down the liquid air separator strips 28 and caught on the collection shelf 36 flows down over the upstream edge of the shelf in the sump 42. The sump is relatively deep and has large cross sectional dimensions so that the water in the sump flows at a substantially lower linear velocity than it experiences along the liquid-air separator strips 28. This water then passes through the strainer 54 and into the lower compartment 58. From there the cooled and now cleaned water flows out of the device via the outlet opening 68 to external utilization means (not shown).

Because the air used to cool the sprayed water in the system ingests atmospheric air which mixes with the water, it is possible for foreign particles such as dirt, leaves etc. to become entrained in the water during its passage through the system. These foreign particles are removed from the water as it passes through the sump and strainer.

As can be seen in FIG. 1, the water flows rapidly down over the upstream edge of the collection tray 31 and down in the sump 42 where it then moves more slowly. This reduction in velocity causes a portion of the entrained particulate matter to be deposited as a first sludge accumulation 79 at the corner of the sump 42 formed by the bottom wall 37 and the vertical wall 38. The portion of the remaining particulate matter in the water which is of size capable of clogging the nozzles 24 is intercepted by the strainer 54. Because of the particular orientation of the strainer, i.e. with its upper edge upstream of the water flow the water which impinges on the strainer is given a downward deflection as shown by the arrow A in FIG. 2. This downward flow of water produces a continual scrubbing action to wash away the particulate matter caught on the surface of the strainer. Because the lower edge of the strainer is downstream of the water flow, the scrubbing is in the direction of particle settlement toward the bottom of the conduit. Accordingly a substantial portion of the particulate matter intercepted by the strainer is deposited as a second sludge accumulation 80 where the strainer meets the bottom wall 18.

It will be appreciated that because of the self cleaning action produced by the above described strainer and sump arrangement the duration between successive cleanings or replacements of the strainer is effectively increased. Also, when the strainer does eventually become loaded with smaller particulate material which has not been washed off, the strainer is easily removed for cleaning or replacement simply by opening the access door 61 and, as shown in FIG. 3, sliding the strainer out from between the guide brackets 52.

Figure 4:
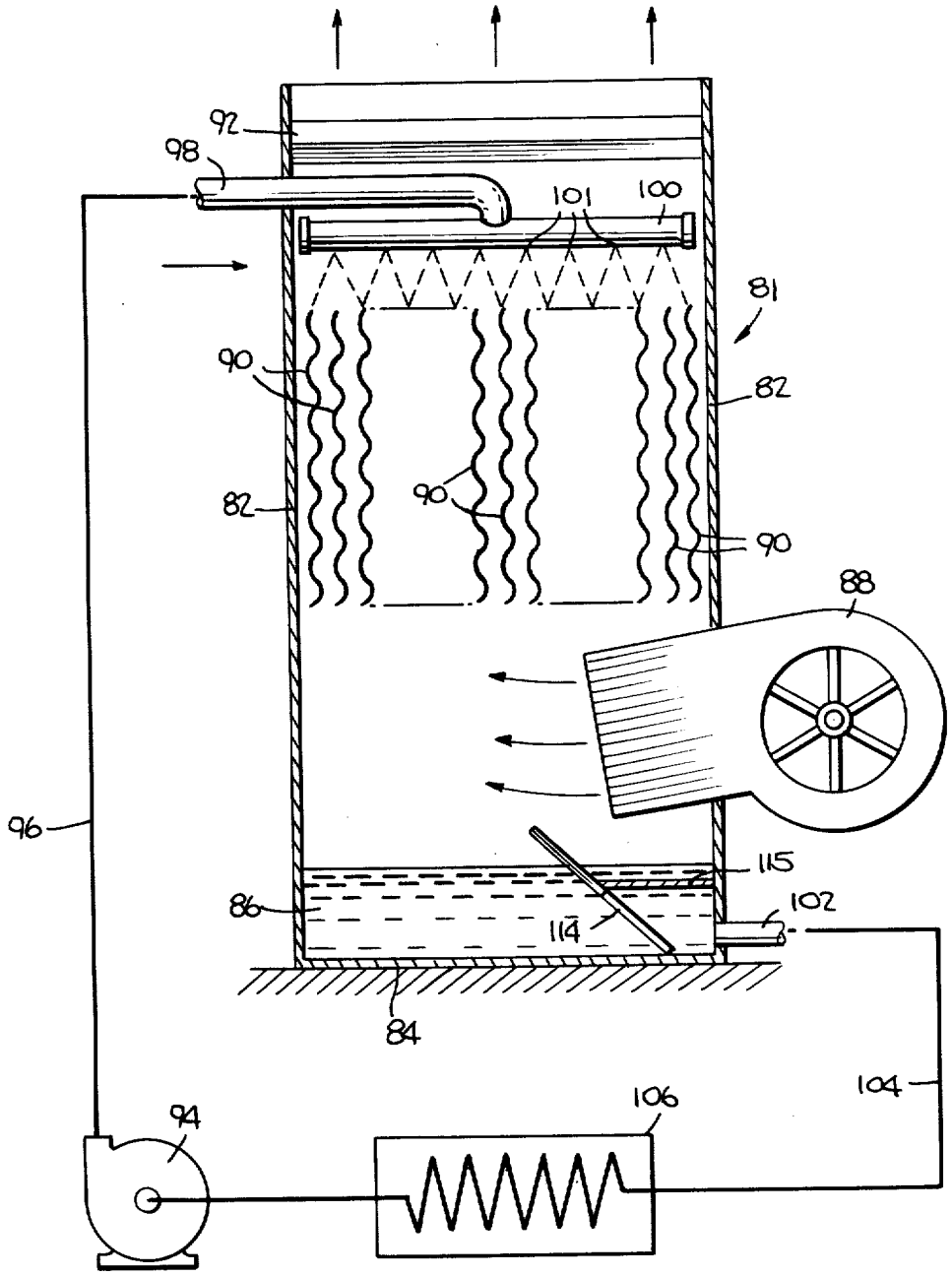
FIG. 4 is a schematic view of a system incorporating the present invention in a counterflow heat exchange system.

Turning now to FIG. 4 it will be seen that there is provided a heat exchange system arranged for recirculatory flow of a heat transfer fluid such as water. The system of FIG. 4 includes a heat exchanger 81 which may be, for example, of the counterflow type shown and described in U.S. Pat. No. 3,290,025. This heat exchanger has upstanding outer walls 82 and a bottom wall 84. A sump 86 is formed in the bottom of the heat exchanger. A blower 88 extends into the side of the heat exchanger just above the sump; and it blows cooling air from the atmosphere into the region enclosed by the walls 82. This air passes upwardly through the device in heat exchange relationship with water which flows down over undulatory plates 90. The air gathers heat from the water and then passes out through mist eliminators 92 and exhausts to the atmosphere. Water to be cooled is supplied to the heat exchanger 81 by means of a pump 94 which drives the water up through a supply pipe 96 to an inlet pipe 98 near the top of the device. The inlet pipe passes in through the walls 82 to distribution manifolds 100 located just above the plates 90. The water sprays out from nozzle openings 101 in the manifolds and flows down in film formation along the plates 90.

After the water has passed down along the plates 90 in heat exchange relationship with the incoming air, it falls down into the sump 86; and then it flows through the sump to an outlet 102. From there the now cooled water is conveyed by an outlet pipe 104 to a utilization means 106. This utilization means may be any device which uses cooled water, for example an air conditioning system for buildings. In making use of the cooled water, the utilization means 106 causes the water to become heated. Thereafter the heated water is driven by the pump 94 back up to the inlet pipe 98 of the heat exchanger 81 for recooling.

A strainer 114 is arranged to extend across the sump 86 in the path of water flow toward the outlet 102. As in the preceding embodiment, this strainer is slanted so that its upper end is upstream in the direction of liquid flow. Thus, during operation of the system of FIG. 4, a continual cleansing action is provided whereby the water to be strained, upon encountering the strainer moves downwardly across its surface to urge particles intercepted by the strainer toward its bottom edge. A strainer cover 115 is provided to prevent particles which drop down through the system from bypassing the strainer.

The system of FIG. 4 also provides an automatic backflushing action that takes place each time the flow of water through the system is stopped. Thus backflushing action takes place due to the difference in head or water level between the top of the inlet pipe 98 and the sump 86. Upon shut-off, the water remaining in that portion of the supply pipe 96 which extends higher than the sump forces back the water in the lower regions of the system so that a corresponding amount of water is driven back into the sump via its outlet 102. This surge of water flows back through the strainer 114 and this backflow washes away particles of foreign material which had been trapped in the strainer. This backflow and accompanying cleaning action take place each time the system flow is stopped.

It will be appreciated that a similar automatic backflushing action will be achieved upon shutoff when an injector type system, such as that shown in FIG. 1, is substituted for the heat exchanger 81 of FIG. 4, so long as the water feed to the injector is higher than the sump level. In each case the liquid, during contact with the atmosphere, falls through the atmosphere; so that upon termination of liquid flow through the system an unbalance exists in the liquid head in the system which forces liquid backwardly through the sump.

Although certain particular embodiments of the invention are herein disclosed for purposes of explanation, various modifications thereof, after study of this specification, will be apparent to those skilled in the art to which the invention pertains.

I claim:

1. An evaporative heat exchange apparatus comprising means for mixing atmospheric air and a liquid for evaporative transfer of heat from one to the other, liquid-air separator means downstream of said mixing means for separating the air from the liquid, sump means comprising horizontal bottom wall and upstanding side and end walls, said sump means being positioned to receive the liquid from said liquid-air separator means near one of said end walls and said sump means being formed to direct a substantially horizontal flow of said liquid in a given direction toward the other end wall, a liquid outlet near said other end wall of said sump means, strainer means for removing particulate matter from said flow path and depositing said matter on the bottom of said sump means, said strainer means including a strainer extending across the entire flow path within said sump means, said strainer extending up from the bottom wall of said sump means, strainer mounting means for securing the lower edge of said strainer on said bottom wall and for securing the upper edge of said strainer in the sump such that the strainer is slanted with respect to the horizontal so that its upper edge is positioned upstream of its lower edge in the horizontal flow of liquid through said strainer with the upper edge of said strainer extending at least up to the upper level of the liquid flowing in said given direction along said flow path so that all of the liquid flowing through the sump must pass through the strainer, and liquid flow control means comprising a liquid flow control plate extending across the sump means between said strainer and said liquid outlet, said liquid flow control plate being configured to maintain an even flow of liquid along the strainer.

2. An evaporative heat exchange apparatus according to claim 1 wherein said strainer means includes a generally flat rectangular strainer element and a pair of elongated channel like guide members positioned along and supporting opposite edges of said strainer element.

3. An evaporative heat exchange apparatus according to claim 2 wherein said strainer element is slidable in said guide members.

4. An evaporative heat exchange apparatus according to claim 3 wherein said guide elements are open at their upper ends for removal of the strainer element.

5. An evaporative heat exchange apparatus according to claim 1 wherein said heat exchange apparatus is an injector type liquid-air contact apparatus comprising a conduit open to the atmosphere at both ends, and having a plurality of liquid spray nozzles distributed across the cross section of said conduit near one end and arranged to spray liquid into said conduit toward its said other end, wherein said liquid-air separator elements are located near said other end of said conduit means for intercepting and collecting the sprayed liquid and wherein said sump means is positioned under said liquid-air separator means.

6. An evaporative heat exchange apparatus according to claim 5 wherein said liquid-air separator means includes a liquid collection shelf positioned in said sump so that liquid from said liquid collection means flows rapidly off its edge and downwardly within said sump.

7. An evaporative heat exchange apparatus according to claim 5 wherein said sump extends below and between said liquid-air separator means and said one end of said conduit.

8. An evaporative heat exchange apparatus according to claim 7 wherein said liquid outlet is arranged in a wall of said sump toward said one end of said conduit.

9. An evaporative heat exchange apparatus according to claim 5 wherein said conduit includes further liquid-air separator means arranged upstream of said nozzles to intercept liquid blown back therefrom and means below said further liquid-air separator means for directing liquid flowing down therefrom into said sump upstream of said strainer means.

10. An evaporative heat exchange apparatus according to claim 5 wherein said sump extends below and between said liquid-air separator means and said one end of said conduit and wherein said liquid outlet is arranged in a wall of said sump toward said one end.

11. An evaporative heat exchange apparatus according to claim 10 wherein said conduit includes a secondary liquid-air separator means arranged upstream of said nozzles to intercept liquid blown back therefrom and a shelf below said secondary liquid-air separator means for directing liquid therefrom up over the upper edge of said strainer means and into said sump upstream of said strainer means.

* * * * *

UNITED STATES PATENT OFFICE

CERTIFICATE OF CORRECTION

PATENT NO. : 3,963,464

DATED : June 15, 1976

INVENTOR(S) : EDWARD N. SCHINNER

It is certified that error appears in the above-identified patent and that said Letters Patent are hereby corrected as shown below:

Title page - Item [73] Assignee: should read

"Baltimore Aircoil Company, Inc., Jessup, Maryland"

Claim 6, line 34, insert --means-- between "sump" and "so;
line 34 - delete "collection" insert --air separator--;
line 35, delete "within" insert --into said first end of--.

Claim 7, line 38 - insert the word --means-- between "sump" and extends.

Claim 8, line 43 - insert the word --means-- between the words "sump" and "toward".

Claim 9, line 49 - insert the words --said first end of--between-- "into" and "said;
line 50, delete "upstream of said strainer".

Claim 10, line 52 - insert the word --means -- between the words "sump" and extends".

Claim 11, line 62 - insert the word --means-- between the words "sump" and "upstream".

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*